US007677831B2

(12) United States Patent
Kulp et al.

(10) Patent No.: US 7,677,831 B2
(45) Date of Patent: Mar. 16, 2010

(54) FLEXIBLE MARKER DEVICE

(75) Inventors: Jack H. Kulp, Dana Point, CA (US); Geoffrey B. Maus, Mission Viejo, CA (US)

(73) Assignee: TrafFix Devices, Inc., San Clemente, CA (US)

( * ) Notice: Subject to any disclaimer, the term of this patent is extended or adjusted under 35 U.S.C. 154(b) by 0 days.

(21) Appl. No.: 11/880,865

(22) Filed: Jul. 24, 2007

(65) Prior Publication Data

US 2008/0075531 A1 Mar. 27, 2008

Related U.S. Application Data

(60) Provisional application No. 60/835,857, filed on Aug. 4, 2006.

(51) Int. Cl.
*E01F 9/012* (2006.01)

(52) U.S. Cl. ..... 404/10; 116/63 C

(58) Field of Classification Search ..... 116/63 C, 116/63 P; 404/9, 10; 40/612
See application file for complete search history.

(56) References Cited

U.S. PATENT DOCUMENTS

| | | | | |
|---|---|---|---|---|
| 3,618,556 | A | 11/1971 | Dittrich | |
| 4,197,807 | A * | 4/1980 | Campbell | 116/63 P |
| 4,611,949 | A * | 9/1986 | Schmanski | 404/9 |
| 5,026,204 | A | 6/1991 | Kulp et al. | |
| 5,305,705 | A * | 4/1994 | Gagliano | 116/63 P |
| 5,375,554 | A * | 12/1994 | Yen | 116/63 C |
| 5,468,093 | A * | 11/1995 | Voigt | 404/6 |
| 5,488,792 | A * | 2/1996 | Kwok | 40/612 |
| 5,560,732 | A | 10/1996 | Kulp et al. | |
| 5,732,911 | A | 3/1998 | Kulp et al. | |
| 5,755,528 | A | 5/1998 | Kulp et al. | |
| 6,019,543 | A * | 2/2000 | Junker | 404/10 |
| 6,402,422 | B1 | 6/2002 | Gertz et al. | |
| 6,712,547 | B1 | 3/2004 | Shauf, Sr. et al. | |
| 6,752,582 | B2 * | 6/2004 | Garcia | 414/467 |
| 6,766,760 | B2 | 7/2004 | Garcia | |
| 6,840,707 | B1 | 1/2005 | Kulp et al. | |
| 6,928,952 | B2 * | 8/2005 | Garcia | 116/63 C |
| 7,056,055 | B1 | 6/2006 | Kuo | |
| 7,228,813 | B2 * | 6/2007 | Flamingo et al. | 116/63 C |
| 2002/0073912 | A1 * | 6/2002 | Kuo | 116/63 P |
| 2004/0146677 | A1 | 7/2004 | Boyd | |
| 2004/0237875 | A1 | 12/2004 | Garcia | |
| 2005/0076822 | A1 * | 4/2005 | Levine | 116/63 C |
| 2006/0016383 | A1 * | 1/2006 | Flamingo et al. | 116/63 C |
| 2006/0093432 | A1 * | 5/2006 | Burlando | 404/9 |
| 2007/0113774 | A1 * | 5/2007 | Kuo | 116/63 C |

OTHER PUBLICATIONS

International Search Report and Written Opinion for corresponding PCT Application No. PCT/US07/16577.

* cited by examiner

*Primary Examiner*—Gary S Hartmann
(74) *Attorney, Agent, or Firm*—Stout, Uxa, Buyan & Mullins, LLP; Donald E. Stout

(57) ABSTRACT

A flexible marker device comprises a marker body having a bottom end and a top end, and a base for supporting the marker body. The base has an aperture in a center portion thereof and a groove extending about the aperture in an upper surface of the base. The bottom end of the marker body is at least partially disposed within the groove. A cured material, preferably polyurethane, is disposed in the groove to thereby secure the marker body to the base.

11 Claims, 2 Drawing Sheets

FLEXIBLE MARKER DEVICE

This application claims the benefit under 35 U.S.C. 119(e) of the filing date of Provisional U.S. Application Ser. No. 60/835,857, entitled *Flexible Marker Device*, filed on Aug. 4, 2006. This provisional application is expressly incorporated herein by reference.

BACKGROUND OF THE INVENTION

The present invention relates generally to traffic marker devices or safety cones used to alert or divert vehicles, pedestrians, and the like, and more particularly to a flexible marker safety device which self-positions to its original configuration, deviates from its original configuration due to natural or traffic-caused perturbations, and is restored to its original configuration from a deviated position in the event the aforementioned perturbations abate.

A traffic marker device of the type contemplated herein is disclosed in U.S. Pat. No. 6,766,760 to Garcia, which patent is herein expressly incorporated by reference. The safety cone disclosed in the Garcia '760 patent is highly utilitarian. However, one of the most difficult aspects of manufacturing such a device is the connection between the bottom part 142 of the marker portion 140, which comprises a conically shaped spring, as shown, and the base 110.

In one prior art approach, the base of such a marker device is molded of polyurethane or the like, and injection molded clips are utilized to attach the base end of the marker to a ring molded in the base This is a relatively expensive product, because of the cost of polyurethane, plus the cost of the ring and the three clips, and because it is labor intensive.

What is needed is an improved, inexpensive, and easy to manufacture approach for connecting the body and the base of a flexible marker device of the type disclosed.

SUMMARY OF THE INVENTION

The present invention addresses the problems noted above by providing an inventive flexible marker device and method of producing same which permits one to avoid the use of expensive polyurethane for fabricating the entire base, thus avoiding substantial costs, while still permitting a superior attachment of the flexible marker body to the base. No mechanical fasteners are required, thus reducing labor requirements substantially.

More particularly, there is provided a flexible marker device, which comprises a marker body having a bottom end and a top end, and a base for supporting the marker body. The base has an aperture in a center portion thereof and a groove extending about the aperture in an upper surface of the base.

The base is preferably comprised of molded vulcanized rubber, but may alternatively be molded of crumb (recycled) rubber, or other suitable materials.

The bottom end of the marker body is at least partially disposed within the groove. A cured material, preferably polyurethane, is disposed in the groove to thereby secure the marker body to the base. Preferably, the cured material substantially fills the groove.

In a preferred embodiment, the marker body comprises a flexible skeleton and a flexible cover disposed over the skeleton. The flexible skeleton preferably comprises a length of flexible material formed in a coil and thus comprising a spring, including a bottom coil which comprises the bottom end of the marker body which is at least partially disposed within the groove. The flexible cover comprises a mesh material having a plurality of small apertures therein, a bottom portion of the mesh material also extending downwardly into the groove.

An advantageous feature of the present invention is that some of the cured material extends through the mesh material, thus assisting in securing the marker body to the base. Also, the groove is preferably shaped so that an upper portion thereof is narrower than a lower portion thereof, whereby portions of the base which define the groove converge toward one another in an upward direction. The bottom end of the marker body which is disposed within the groove is at least partially constrained from exiting the groove by the converging portions of the base. More particularly, the groove is defined in part by a wedge-shaped portion of the base which tapers inwardly in an upward direction. Thus, the bottom end of the marker body which is disposed within the groove is disposed against the wedge-shaped portion of the base so that the base portion mechanically constrains the bottom end of the marker body from exiting the groove. In the presently preferred embodiment, the groove is further defined by an overhanging portion of the base.

In another aspect of the invention, there is disclosed a method of manufacturing a flexible marker device, which comprises steps of providing a base having a groove molded therein and placing a bottom end of a marker body in the groove. Additional method steps include pouring a molten material, preferably polyurethane, into the groove, as well as curing the molten material to harden same, in order to secure the marker body bottom end in the groove.

Preferably, the marker body comprises a flexible skeleton having a bottom coil and a cover disposed over the flexible skeleton, wherein the cover comprises a mesh material. The bottom coil is disposed in the groove during the placing step. More preferably, a portion of the mesh cover also extends into the groove. In such case, the pouring step comprises pouring the molten material through the mesh material, so that when the molten material is cured, it extends through the mesh material and functions to help secure the marker body to the base.

In preferred methods, the aforementioned providing step includes a step of molding the groove into the base so that portions of the base defining the groove taper toward an upper opening of the groove. The placing step preferably comprises disposing the marker body bottom end beneath the tapered groove portion to help retain the marker body bottom end within the groove.

The invention, together with additional features and advantages thereof, may best be understood by reference to the following description taken in conjunction with the accompanying illustrative drawing.

DESCRIPTION OF THE PREFERRED EMBODIMENT

Figure 1:
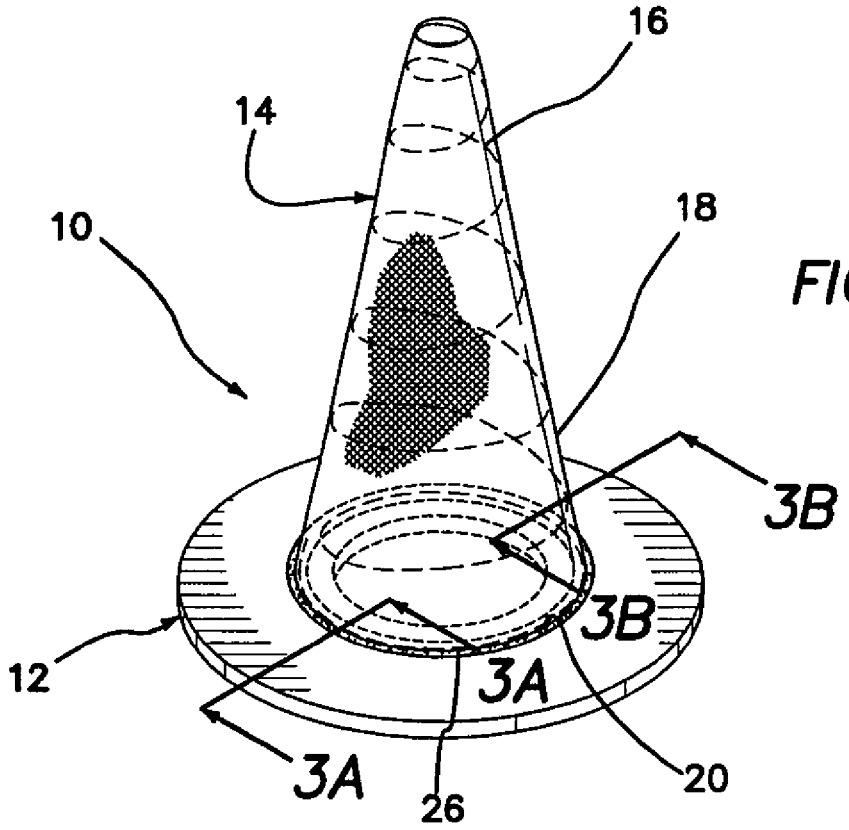
FIG. 1 is a perspective view of an embodiment of a flexible marker according to the invention.

Referring now more particularly to the drawings, there is shown in FIG. 1 a flexible marker device 10 comprising a base 12 and a marker body 14. The marker body 14 may be constructed in a manner similar to that disclosed in the Garcia '760 patent, comprising a flexible skeleton 16 over which is disposed a flexible cover 18. The flexible skeleton 16 is preferably comprised of a length of flexible metal, such as steel, formed in a coil and thus comprising a spring, wherein the flexible metal may be either round or flat stock. Other marker body shapes, and other materials may be utilized as well, within the scope of the invention.

Figure 2:
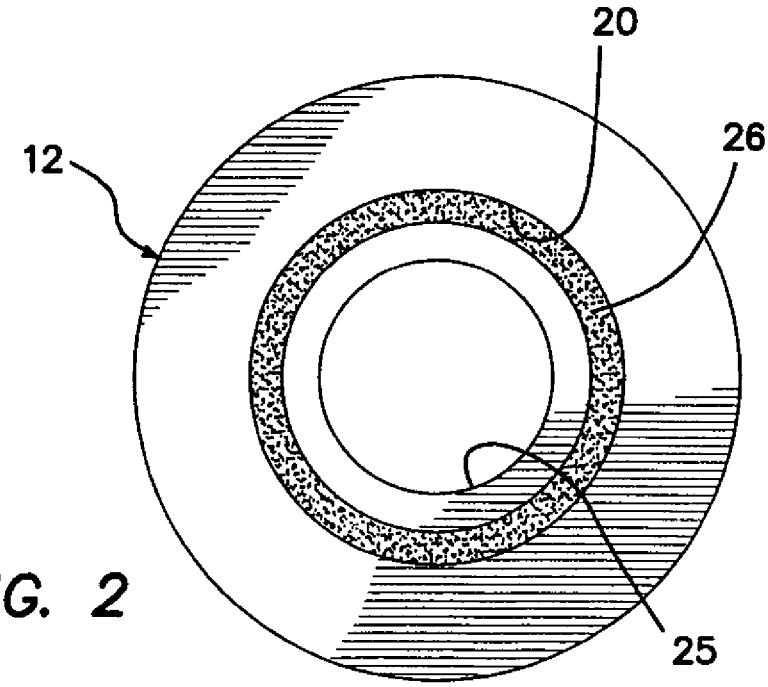
FIG. 2 is a top view of one embodiment showing details of the base and marker construction.
Figure 3A:
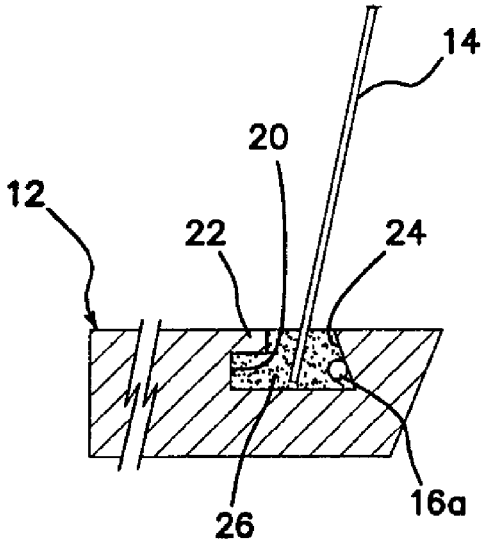
FIG. 3A is a cross-sectional view along lines 3A-3A of FIG. 1, showing particular details of the connection between the base and the marker of the invention.
Figure 3B:
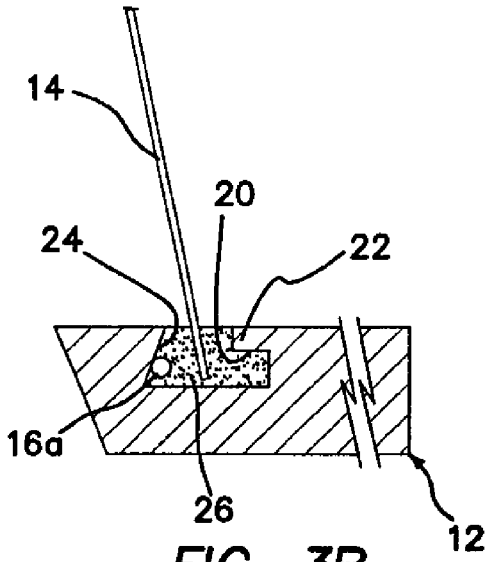
FIG. 3B is a cross-sectional view along lines 3B-3B of FIG. 1, showing details similar to those shown in FIG. 3A, along a different portion of the connection between the base and the marker of the invention.

Now referring, as well, to FIGS. 2, 3A, and 3B, the base 12 preferably comprises molded vulcanized rubber throughout most of its volume. It may also be comprised of non-vulcanized scrap or crumb rubber, for example, or other suitable material. The base may be round, as shown, square, or any other desired shape, such as the shape shown for base 12 in FIG. 4. In one embodiment, the base is designed to have a molded weight of approximately 3 to 3½ pounds. The base includes a molded groove 20 which is uniquely shaped, as shown, as a sort of "cog wheel" or "gear tooth design", so that the groove is defined, in part, by an overhanging portion 22 and a wedge-shaped tapering portion or ledge 24. The purpose of the groove 20 is to receive and retain a bottom coil 16*a* of the flexible skeleton 16. Preferably, the bottom coil 16*a* is disposed within the groove 20 so that it lies beneath the ledge 24, as shown in FIGS. 3A and 3B. In the center of the base is disposed an aperture or opening 25. This aperture or opening 25 is particularly adapted for receiving a top end of a second marker device for the purpose of stacking a plurality of the marker devices for transport or storage, as is known in the art.

In one particular embodiment, the groove 20 is molded to a depth of about ⅜ inches, and is disposed radially about 11½ inches from the center of the base. The ledge 24 overhangs the groove 20 by a distance of about ⅞ inches. Of course, these dimensions, as well as other particular design features, may be changed as appropriate within the scope of the present invention.

Once the marker device 10 is assembled, as shown in FIG. 3, polyurethane 26 is poured into the groove 20 until it is substantially filled, as shown in FIGS. 1-3B. The polyurethane is then permitted to air dry in order to cure and to seal the coil 16*a* within the groove. Suitable alternatives to polyurethane may be used instead.

Figure 4:
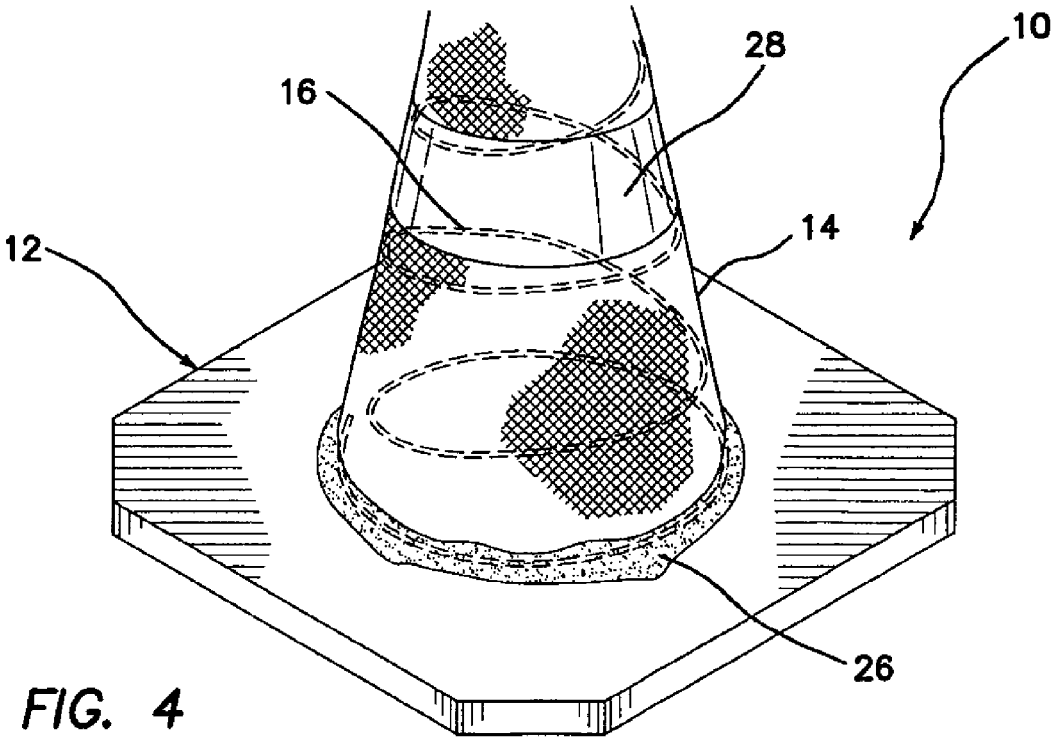
FIG. 4 is a perspective view of a modified embodiment of the invention, illustrating that the cone body is formed of a mesh material, and that the base may be comprised of an alternate shape.

As shown in FIG. 4, the body 14 of the marker is preferably fabricated from a mesh material, either fabric or plastic. Reflective stripes 28 may be disposed on the body 14 at any desired location, as is well known in the art.

In the preferred method of the present invention, as noted above, the bottom portion of the marker device 10, including the bottom coil 16*a* of the flexible skeleton 16, is placed within the groove. Once in place, as shown particularly in FIGS. 3A and 3B, the molten polyurethane is poured into the groove 20 so that it goes through the mesh wall of the marker body 14. Thus, as the polyurethane hardens during the curing process, it is intertwined within the apertures of the mesh wall, so that an additional connection between the marker body and the base is created. As shown in FIG. 4, the cured polyurethane substantially fills the groove, and, in fact, may flow out and over surrounding portions of the base.

Advantages of the present invention include, but are not necessarily limited to, the following:

1) the coil 16*a* is secured within the base in two ways—both by the cured polyurethane, and because it is disposed beneath the ledge 24, and thus held in place thereby;

2) no mechanical fasteners are required;

3) labor costs are much reduced;

4) Use of rubber, rather than solid polyurethane throughout, greatly reduces material costs, since the per pound cost of polyurethane is presently about three to four times the per pound cost of rubber. However, the use of polyurethane in the groove 20 still permits one to take advantage of the superior retention characteristics of polyurethane relative to vulcanized rubber; and 5) The engagement of the polyurethane and the mesh walls of the marker body, as described above, provides an additional securement of the marker body and the base without the use of mechanical fasteners.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A flexible marker device, comprising:

a marker body comprising a flexible skeleton and a flexible cover disposed over said skeleton, the marker body having a bottom end and a top end; and a base for supporting said marker body, said base having an aperture in a center portion thereof and a groove extending about said aperture in an upper surface of the base;

the bottom end of said flexible skeleton being at least partially disposed within said groove; and a cured material also disposed in said groove to thereby secure said flexible skeleton to said base.

2. The flexible marker device as recited in claim 1, wherein said flexible skeleton comprises a length of flexible material formed in a coil and thus comprising a spring, including a bottom coil which comprises the bottom end of said flexible skeleton which is at least partially disposed within said groove.

3. The flexible marker device as recited in claim 2, wherein said flexible cover comprises a mesh material having a plurality of small apertures therein, a bottom portion of said mesh material also extending downwardly into said groove.

4. The flexible marker device as recited in claim 3, wherein some of the cured material extends through the mesh material, thus assisting in securing the marker body to the base.

5. The flexible marker device as recited in claim 1, wherein said groove is shaped so that an upper portion thereof is narrower than a lower portion thereof, whereby portions of said base which define said groove converge toward one another in an upward direction.

6. The flexible marker device as recited in claim 5, wherein said bottom end of said marker body which is disposed within said groove is at least partially constrained from exiting the groove by said converging portions of said base.

7. The flexible marker device as recited in claim 5, wherein said groove is defined in part by a wedge-shaped portion of the base which tapers inwardly in an upward direction, the bottom end of the marker body which is disposed within said groove being disposed against said wedge-shaped portion of the base so that the base portion constrains the bottom end of the marker body from exiting the groove.

8. The flexible marker device as recited in claim 7, wherein said groove is further defined by an overhanging portion of the base.

9. The flexible marker device as recited in claim 1, wherein said cured material comprises polyurethane.

10. The flexible marker device as recited in claim 1, wherein said base comprises rubber.

11. The flexible marker device as recited in claim 1, wherein said cured material substantially fills said groove.

* * * * *